United States Patent [19]

Carlsson et al.

[11] 3,933,297

[45] Jan. 20, 1976

[54] PACKING CONTAINER

[75] Inventors: Lars C. Carlsson, Staffanstorp; Göran K. Larsson, Dalby; Jan F. Palsson; Hans A. Rausing, both of Lund, all of Sweden

[73] Assignee: Tetra Pak Developpement SA, Lausanne, Switzerland

[22] Filed: Feb. 11, 1974

[21] Appl. No.: 441,219

[30] Foreign Application Priority Data

Feb. 20, 1973 Sweden ..... 7302411

[52] U.S. Cl. ..... 229/3.1; 229/37; 229/43

[51] Int. Cl.[2] .. B65D 5/40; B65D 5/56; B65D 25/14

[58] Field of Search..... 229/3.1, 2.5, 5.5, 37 R, 229/43, 48 T

[56] References Cited

UNITED STATES PATENTS

| | | | |
|---|---|---|---|
| 2,140,177 | 12/1938 | Walter | 229/3.1 |
| 2,378,972 | 6/1945 | Bode | 229/3.1 X |
| 2,437,114 | 3/1948 | Moore | 229/3.1 X |
| 2,784,901 | 3/1957 | Wilcox | 229/5.5 X |
| 3,064,874 | 11/1962 | Kauffeld | 229/37 R X |
| 3,406,891 | 10/1968 | Buchner et al. | 229/2.5 X |

*Primary Examiner*—Davis T. Moorhead

*Attorney, Agent, or Firm*—Pierce, Scheffler & Parker

[57] ABSTRACT

The invention, relating to cylindrical or prismatic, disposable containers for liquids, which containers have top and bottom end closures, comprises forming an end closure from a disk which is fixed to an end opening region of the container body by fusing together the common contact surfaces of the disk and said region or by means of a heat-activatable bonding agent.

4 Claims, 23 Drawing Figures

Fig. 11.
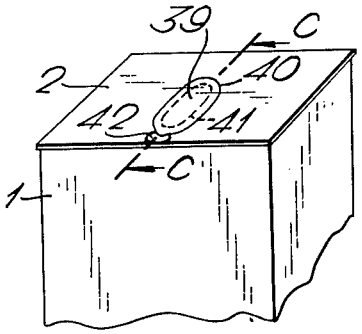
Fig. 11a.
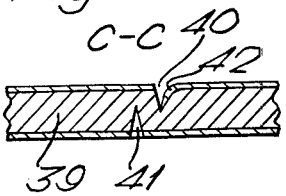
Fig. 12.
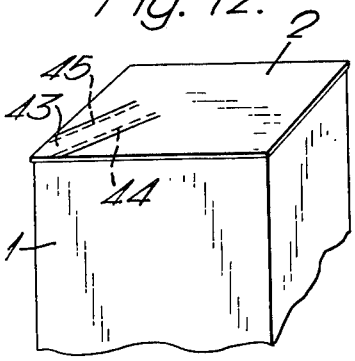
Fig. 12a.
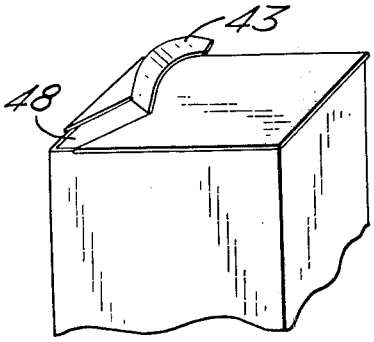
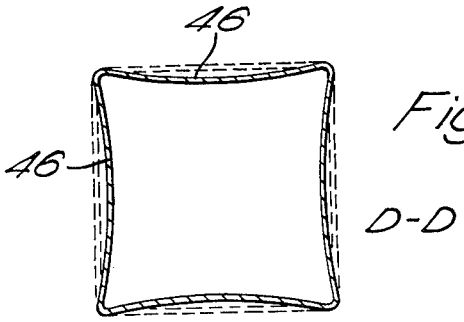
Fig. 13.

PACKING CONTAINER

The present invention relates to a packing container comprising a cylindrical or prismatic container body together with top and bottom end closures which are attached tightly to the top and bottom end openings respectively of the container body.

It is known in the technology of packing that liquid containers of a disposable character can be manufactured of plastic-coated paper or cardboard by producing the package blank which by folding is given the desired form and which after filling can be closed in that wall panels connected with the body of the package are combined and sealed to one another with the help of pressure and heat. In such known packing containers the end closures of the body of the package are formed as a rule by material layers overlapping one another, which entails unnecessary large consumption of packing material, so that the packing container becomes relatively expensive to manufacture.

These disadvantages are overcome by the packing container in accordance with the invention, which is characterized in that at least one of the end closures of the container body consists of a disk or a lid which is fixed to the one end opening region of the container body by fusing together of the common contact surfaces of the disk or lid and the end opening region, or by means of a heat-activatable bonding agent, so-called "hotmelt" applied for the purpose. The invention is characterized further in that the said end closure disk consists of a substantially compressible, or in warm condition plastically deformable plastic material, which e.g. may consist of plastic foam material.

Figure 1:
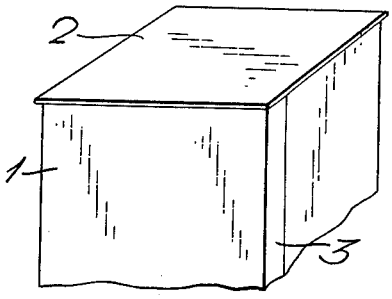
Figure 1A:
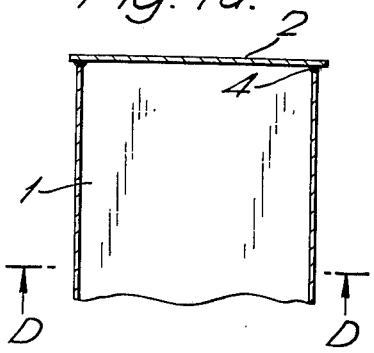
Figure 2:
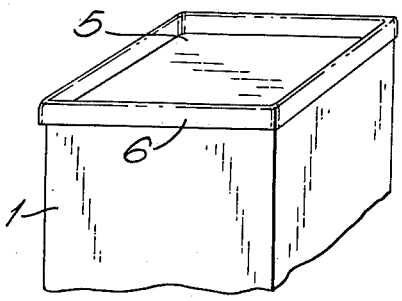
Figure 2A:
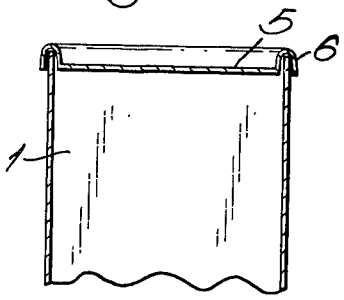
Figure 3:
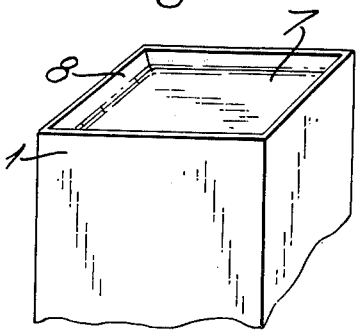
Figure 3A:
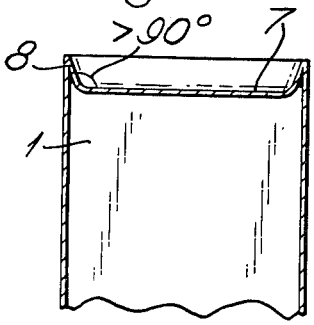
Figure 4:
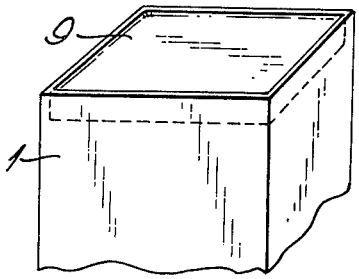
Figure 4A:
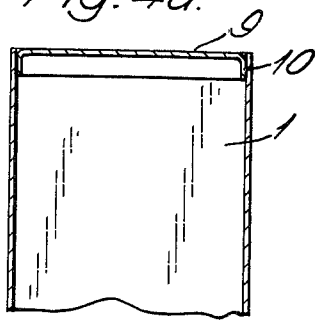
Figure 5:
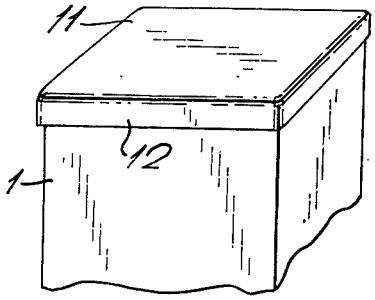
Figure 5A:
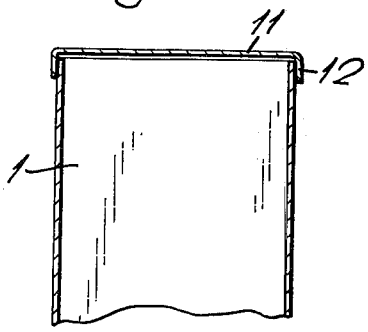
Figure 6:
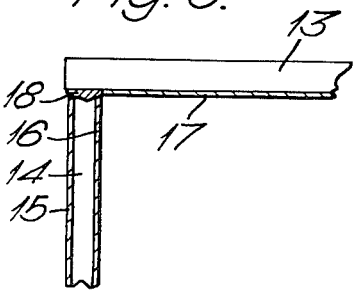
Figure 7:
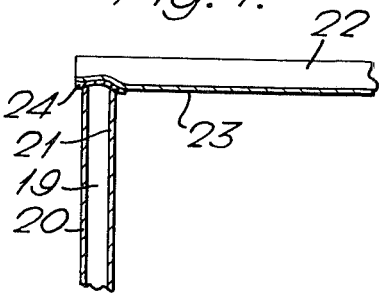
Figure 8:
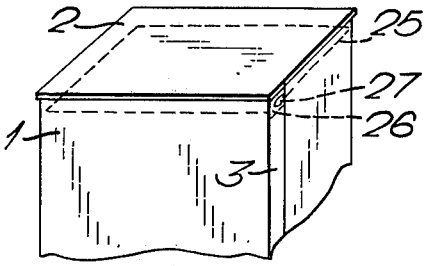
Figure 8A:
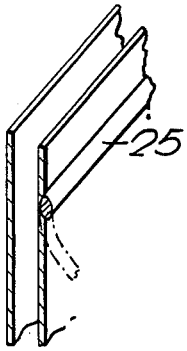
Figure 9:
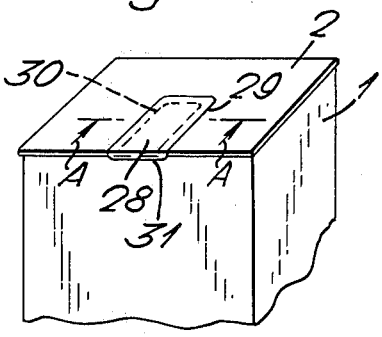
Figure 9A:
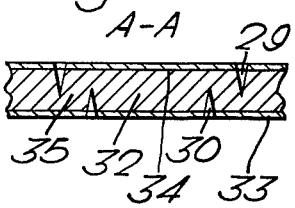
Figure 10:
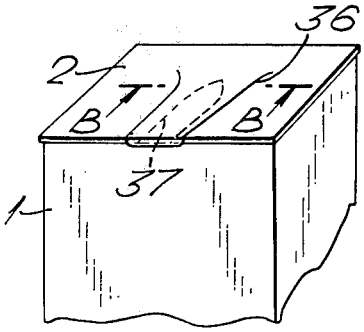
Figure 10A:
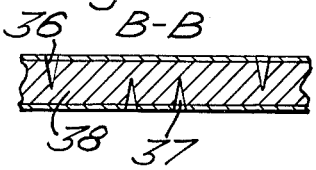

In the following the invention will be described with reference to the enclosed schematic drawing, in which FIG. 1 and 1*a* show a packing container in accordance with the invention with plane, butt welded end plate, FIG. 2 and 2*a* show a packing container in accordance with the invention with an end disk or end plate, whose edge region embraces the top edge of the container body, FIG. 3 and 3*a* show a packing container in accordance with the invention with an inserted end closure disk, FIG. 4 and 4*a* show a packing container in accordance with the invention with an end closure disk fitted inside the container body and provided with flanges, FIG. 5 and 5*a* show a packing container in accordance with the invention with an end closure disk folded down around the top edge of the container body, FIG. 6 shows a butt joint between an end closure disk and a container body, the sealing being carried out by means of a heat-activatable bonding agent, FIG. 7 shows a butt joint between an end closure disk and the container body, the top opening edge of the container body and/or the end closure disk being deformed to produce a tight, continuous sealing joint, FIG. 8 and 8*a* show a packing container in accordance with the invention, which packing container is provided with an opening indication in the form of a thread attached to the inside of the container body, FIG. 9 and 9*a* show a packing container in accordance with the invention which is provided with an opening indication, by means of which a part of the end closure disk can be torn off in order to make the contents of the packing container accessible, FIG. 10 and 10*a* show a packing container with an opening indication in the top end closure disk, FIG. 11 and 11*a* show a packing container with an opening indication in the top end closure disk, FIG. 12 and 12*a* show a packing container in accordance with the invention with an opening indication quite near to one of the corners in the top end closure disk, and FIG. 13 shows a cross-section through the packing container in accordance with the invention.

Although the packing container in accordance with the invention may very well have a circular-cylindrical or any other shape of the container body, it is assumed, for the sake of clarity, in the following description that the container body has an approximately square cross-section and that it is made from a blank, which has been given prismatic shape by folding, and the edges of which have been joined together in a longitudinal sealing joint. The container body of the packing container can be manufactured for example of paper or cardboard, which at least on the inside, but preferably on both sides, has been coated with a thermoplastic material, e.g. polyethylene, which thermoplastic material on the one hand acts as a liquid-tight barrier, on the other hand constitutes a sealing layer, by means of which the material layers put together can be sealed to one another by surface fusing of the plastic coating placed upon one another. The container body of the packing container can also be made of some other material such as e.g. foamed plastic, which on the one side or on both sides is provided with coats of a homogeneous plastic material.

The packing container shown in FIG. 1 has a container body with square cross-section. The container body 1 is made from a blank, the longitudinal edges of which are joined in a sealing joint 3, which in the case shown here is located quite close to the lateral edge of the container body. The bottom opening of the container body 1 is provided with an end closure of any kind, and its top opening is closed by an end closure disk 2, which wholly covers the top opening of the container body 1. In FIG. 1a which shows a longitudinal section through the packing container in accordance with FIG. 1, it is shown how the top end closure disk 2 is fixed to the container body 1 by means of a layer of bonding agent 4. The layer of bonding agent 4 consists of a so-called "hotmelt", that is to say a mixture of thermoplastic material, preferably plastics and waxes, the adhesive effect of which can be activated through the application of heat. The melting point of the layer of bonding agent 4 should be lower than the melting points of the plastic materials included in the container body 1 or the end closure disk 2, and the material included in the layer of bonding agent 4 should be able in activated condition to adhere to the top edge of the container body 1 as well as to the top end closure disk 2 in order to achieve a tight and mechanically durable seal between the container body 1 and the end closure disk 2.

The layer of bonding agent 4 can be applied either to the top edge region of the container body 1 in that the same is dipped slightly into a bath containing melted hotmelt material directly before the end closure disk 2 is applied over the opening of the container body 1, or else the bonding agent layer 4 can be applied around the edge of the end closure disk 2 before the two parts are put together.

The version which is shown in FIG. 1 has a plane end closure disk 2 which is joined by a butt joint to the container body 1. In FIG. 2 another version of the packing container is shown, whose end closure disk 5 is provided with a U-shaped channel 6 arranged beforehand, which runs around the edge of the end closure disk 5. The said U-shaped channel 6 is adapted so that the top edge region of the container body 1 can be taken up in the said U-shaped channel of the end closure disk 5 and the end closure disk 5 can be fixed finally to the container body 1 by pressing together under simultaneous application of heat the parts of the U-shaped channel 6 projecting from the end closure disk 5, whilst they take up between themselves the top edge of the container body 1. It is assumed here that the container 1 as well as the inside of the end closure disk 5 are provided with a coating of thermoplastic material, or else that the container body 1 and/or the end closure disk 5 are made of thermoplastic material, a tight and mechanically durable joint being obtainable between the end closure disk 5 and the container body 1 by surface fusing of the plastic material. It is also possible in the versions of the package shown in FIG. 2 and 2*a*, in place of the heat sealing to use a bonding agent of the aforementioned type, that is to say a "hot-melt", which is activated by heat and is applied in the connecting region between the container body 1 and the end closure disk 5.

In FIG. 3 is shown a packing container comprising a container body 1 and an end closure disk 7, whose edge region has a flange 8 directed upwards and extending around the end closure disk. FIG. 3 illustrates that the flange 8 should have a slope towards the end closure disk 7, which is greater than 90°, which implies that the end closure disk, when it is fitted into the container body 1, connects in wedge-shape with its flange 8 to the top edge region of the container body 1, a relatively high contact pressure being obtained between the flange 8 and the top edge region of the container body 1. The fixing of the end closure disk 7 can be achieved so that the inside of the top edge portion of the container body 1 is heated up by means of radiant heat or hot air in the intention of causing the thermoplastic coating applied inside the container body 1 to melt, whereupon a similar heating operation is carried out against the outside of the flange 8. Finally the end closure disk 7 is pressed into the top opening of the container body 1, the plastic layer, softened or melted by the application of heat, being caused to fuse together for obtaining a tight and mechanically durable sealing joint between the flange 8 of the end closure disk 7 and the upper edge region of the container body 1, In cases where the contact pressure which is achieved by means of the above-mentioned shaping of the flange is not sufficient, it is possible by means of a pressure device to grip around the combined portions of the flange 8 of the end closure disk 7 and the edge region of the container body 1, and to apply a pressure, which presses the said parts together. This may prove necessary in particular in the corner parts, where the wedge-shaped forming of the flange 8 under certain circumstances cannot be accomplished with the amount of accuracy to ensure the contact pressure necessary for the sealing. As in the other versions of the packing containers in accordance with the invention mentioned earlier the end closure disk may also be constituted of a plastically deformable material, e.g. homogeneous plastic material or foamed plastic material, which is provided preferably with a surface coating of homogeneous plastic material. By making the end closure disk of such a material, which is plastically yielding when it is subjected in heated condition to a pressure, it is readily possible to cause the flange portion 8 of the end closure disk 7 to connect closely to the inner contour of the container body 1, in that certain parts of the end closure disk, which are subjected to higher pressure stresses than others, become deformed more easily. It is also possible to make the container body 1 of a foamed plastic material and thus make use of the plastic deformability of the plastic material when fitting the end closure disk 7 into the opening of the container body 1.

In FIG. 4 is shown a further embodiment of the invention, wherein the end closure disk 9 is provided with a flange 10 folded inwards, which is intended to be fitted into the opening of the container body 1. The fitting in of the end closure disk 9 may be carried out for example in such a manner, that it is applied to the front end of a mandrel with its downward flange 10 embracing the front edge of the mandrel, whereupon a blank for the container body 1 is wrapped round the mandrel in such a manner, that the top edge region of the container body 1 formed is made to come into overlapping contact with the folded down flange 10. Moreover it is ensured that the top edge of the container body 1 will be comprised in the same plane as the end closure disk 9. Before the blank which is intended to form the container body 1 is wrapped round the said mandrel the outside of the flange 10 has to be heated by e.g. radiant heat or hot air, and preferably also the edge region of the blank wrapped round is heated, so that the top edge region of the container body 1 formed and the outside of the folded down flange 10 are sealed to one another when the blank, which is intended to form the container body 1, is wrapped round the container body 1.

It is also possible to prepare in advance the container body 1 as a tube of arbitrary cross-section, and subsequently by means of a plunger to which the end closure disk is attached, push this through the container body 1 from its one opening to its other opening, where it is fixed by means of heat-sealing, in that heat is applied from the outside of the container body and/or from the inside by pressing a heated sealing device against the inside of the flange 10 of the end closure disk 9. It is also possible to apply in advance a bead of a heat-activatable bonding agent, so-called "hotmelt", around the top edge of the container body 1 and to bring the edge region 10 of the end closure disk 9 into contact with this bonding agent, in that by means of a plunger or a mandrel the end closure disk 9 is pushed through the container body 1 up to and level with the opening of the container body 1, which is intended to be closed by means of the end closure disk 9.

In FIG. 5 is shown a variant of the packing container in accordance with FIG. 4. The packing container shown in FIG. 5 has an end closure disk 11 with an edge flange 12 folded downwards, which is dimensioned so that the edge flange 12 will be in contact against the outside of the container body 1 when the end closure disk 11 is applied over the opening of the container body 1. In the sealing of this end closure disk 11 too it is appropriate to apply the container body 1 to a mandrel so as to achieve sufficient inner support when the sealing operation is carried out, in that the plastic coatings on the inside of the flange 12 and on the upper edge region of the container body 1, heated up to the sealing temperature, are pressed against one another in order to obtain a tight and mechanically durable seal between the end closure disk 11 and the container body 1.

As in the previously described case, in place of the direct heat seal of plastic layer placed against one another, the end closure disk 11 can also be applied over the opening of the container body 1 by the application of a bead of hotmelt, either on the inside of the flange 12 or on the outside of the container body 1 and along its edge region. Furthermore the end closure disk 11 and/or the container body can advantageously be made of foamed plastic material or homogeneous plastic material, which material, as mentioned previously, has the property that it can readily be plastically deformed when it is subjected to pressure after it has been heated up to softening temperature.

In the foregoing some examples have been given of packing containers in accordance with the invention, and it has been pointed out, that the end closure disks and/or the container bodies can advantageously be manufactured of e.g. foamed plastic material. To explain the advantages that are obtained by using a foamed plastic material, we will mention in the following some of the characteristic properties which such foamed plastic material has and which are significant in this context.

It has been known for a long time that foamed plastic material can be manufactured in the form of webs or sheets by extruding a melted plastic material through a slot-shaped nozzle. To accomplish the special foam structure a gas or a gas-forming liquid has been mixed previously into the plastic material, which gas or gas-forming liquid is distributed uniformly and dissolved in the plastic material, and which boils at a relatively low temperature. When the plastic material is pressed out through the extruder nozzle, and is thus subjected to a rapid and large drop in pressure, the gas or liquid dissolved in the plastic material evaporate suddenly and form a quantity of small bubbles which impart a cellular structure to the extruded material. The extruded plastic material will have low density, high heat insulating capacity, great mechanical strength in relation to its weight, and it is therefore extremely suitable as a support material in the packing laminate. As a support material in packing laminate foamed plastic has the further advantage that no absorption of liquid can take place on the cutting edges, which is the case e.g. with paper and cardboard material, whose edge regions have to be protected from direct contact with liquid through impregnation or covering by plastic strips. A support material of foamed plastic of the above-mentioned type can easily be provided with surface coats of homogeneous plastic material. It is possible to manufacture foamed plastic from polyethylene, polypropylene, polystyrene, polyvinyl chloride and a number of other thermoplastics. One of the special properties which make the foamed plastic material particularly suitable as a material for the manufacture of packages in accordance with the present invention, is the capacity of the foamed plastic material, especially after heating, to be plastically deformed when subjected to pressure. As a rule this plastic deformation of the foamed plastic material is both positive and negative, that is to say the material is readily compressed to a thickness which is only some ten per cent of the original thickness of the foamed plastic material when it is subjected to pressure, whilst the foamed plastic material as a rule expands a little, that is to say it increases in thickness, when it is only subjected to the effect of heat without simultaneous compression by outside forces. This property of the foamed plastic material makes it very easy to obtain a tight fit between the container body and an end closure disk in accordance with anyone of the embodiments described earlier of the packing container, since possible channels and interspaces between the end closure disks and the container bodies are easily compensated, in that the foamed plastic material is compressed at the points where it is subjected to high pressure, whilst it expands in the other parts. In this manner contact is achieved between the end closure disks and the top edge of the container body in a closed joint around the container body, whereby a completely tight seal between the two parts is obtained. Even in case the sealing between the end closure disks and the container bodies does not take place with the help of heat but by means of a heat-activatable bonding agent, so-called hotmelt, this plastic deformation of the foamed plastic material can be made use of, since the foamed plastic material is plastically deformable also in cold condition when it is subjected to pressure, even if it cannot be deformed as easily as when the foamed plastic material has been heated up and the cells in the material can easily be pressed together.

FIG. 6 will illustrate the packing container which is also shown in FIG. 1, that is to say a packing container which has an end closure disk 13 of e.g. polystyrene foam, the inside of which has a coat of homogeneous thin polystyrene material. The container wall 1 has a supporting layer 14 of either paper or cardboard, or also of foamed plastic material, and the coating layers 15, 16 on either side of the support layer 14 may preferably consist of a homogeneous thermoplastic coating layer. The contact zone between the plastic coating 17 of the end closure disk 13 and the top edge of the container body 1 has a layer 18 of a heat-activatable bonding agent, so-called hotmelt, which preferably consists of mixtures of plastics and waxes and whose temperature of activation is lower than the softening temperature of the rest of the plastic materials entering into the packing container. As mentioned earlier the layer of bonding agent 18 can be applied in advance around the top edge of the container body 1 or along the edge zone of the end closure disk 13, whereupon the end closure disk 13 and the container body 1 are combined after the bonding agent 18 has been activated by heating. The layer of bonding agent 18 taken by itself has a certain thickness which can even out possible discontinuities or deficient fitting between the end closure disk 13 and the container body 1, which means that it is possible to achieve a tight and continuous sealing joint around the whole of the contact surface. In case the layer of bonding agent 18 is not sufficiently thick for filling out possible discontinuities or deficient fitting, the foamed plastic material in the end closure disk 13 can be compressed, so that a complete and unbroken contact region is obtained. This compression can be achieved by pressing a pressing tool against the end closure disk 13 and so compressing the parts which have first been brought into contact with the top edge of the container body 1 until all parts around the top edge region of the container body have been brought into contact with the end closure disk 13.

In FIG. 7 a part of a section of a packing container is shown with a container body 1 comprising a support layer 19, of for example paper or cardboard or also of foamed plastic material, and homogeneous plastic coatings 20, 21 arranged on either side of the support layer, the inner plastic coating 21 having a projecting portion 24, which is folded over the top edge of the container body 1. It is assumed in the present case, that the end closure disk 22 consists of foamed plastic material, the inside of which has a coating 23 of homogeneous plastic material. When the end closure disk 22 is to be sealed to the container body 1, the top edge region of the container body together with the corresponding edge area of the end closure disk 22 is heated to sealing temperature, whereupon the parts are combined and pressed together so that a surface fusion of the compressed materials is obtained. In sealings of this type it has to be ensured that the plastic material in the coating layer 23 has an affinity to the plastic material in the part folded over 24, so that an effective surface fusion and sealing can take place. It is thus not appropriate to use in the end closure disk an inside coating of polystyrene, whilst the inside layer 21 of the container body, and hence also the plastic edge 24 folded over, consists of polyethylene, since polyethylene and polystyrene can be sealed to one another only with difficulties. On the other hand, if both the material layers 23, 24 are of polystyrene material a tight and durable sealing joint can be obtained by pressing the end closure disk 22 heated to sealing temperature against the upper edge of the container body. As can be seen from FIG. 7, the edge region of the end closure disk 22 will be compressed in the area 47, in that it is subjected to a plastic deformation in connection with the sealing operation. As mentioned earlier, this plastic deformation is obtained owing to the cells in the foamed plastic material collapsing when the heated foamed plastic is subjected to pressure, and at the same time, in the manner described earlier, an unbroken contact region is achieved between the end closure disk 22 and the top edge of the container body 1. It is not absolutely necessary, as is shown in FIG. 7, to provide the container body with a folded over plastic edge 24, but in most cases sufficient strength of seal can be achieved when the inside layer 23 of the end closure disk 22 is joined in a butt joint to the inside layer 21 of the support material 19. In the case where the support layer 19 of the container body 1 is also constituted of foamed plastic material a very durable and tight butt joint is obtained owing to the great thickness of the support material in relation to the layer of coating 21.

The packing containers in accordance with the invention described earlier can easily be provided with effective opening devices and such a device is shown in FIG. 8, which illustrates a packing container with a container body 1 of square cross-section and a plane end closure disk 2 which is sealed to the top edge of the container body 1. In the package shown in FIG. 8 the blank for the container body 1 has been provided beforehand with a tearing strip or a tearing cord 25, which is applied against the side of the blank which forms the inside in the packing container, and is located quite close to the top edge of the container body 1. In the finished package the tearing strip 25 will be accessible at the upper part of the overlap joint 3 owing to a cut 27 being provided in the overlap joint and the outer edge region of the overlap joint 3 not being sealed to the container body. In this manner a lug 26 is formed, which can be seized by the fingers and to which lug is attached the tearing strip 25. If the lug 26 is drawn around the packing container, the tearing thread 25 will rip through the top part of the container body 1 and separate that part of the packing container which is situated above the tearing thread 25. This tearing operation can be performed if the container body is manufactured of paper material, but the tearing operation is much easier to be carried out in case of the container body being made of foamed plastic material. In FIG. 8*a* is shown a detail of how the tearing thread 25 is fitted to the inside of the container body 1, for example by providing the tearing thread 25 with a wax or plastic coating and by heat-sealing it to the inside layer of the container body 1. In FIG. 9–12 is shown another type of opening indication which is based on the principle that the end closure disk is manufactured of a foamed plastic material, which preferably is provided with a coating of homogeneous plastic material on one or on both sides. In the end closure disk cutting lines are provided on both sides, which cutting lines are slightly displaced laterally in respect of one another so that the points or inner parts of the cuts do not meet. The distance between the cutting lines must not be greater however than that, on pulling at the material, the same will break between the inner parts of the cutting lines and thereby bring about a convenient ripping up of the end closure disk along the desired tearing line. Since the end closure disk is made of foamed plastic material, there is no absorption of liquid into the material, in spite of the homogeneous inside plastic layer on the end closure disks being broken through by the cutting lines.

In FIG. 9 is shown an opening indication of the type mentioned above where the cutting line 29 provided in the top side of the end closure disk 2 extends along the end closure disk along a U-shaped line, whilst another cutting line 30 is provided on the inside of the end closure disk 2 likewise along a U-shaped line but in such a manner, that the two cutting lines 29, 30 are slightly laterally displaced in respect of each other. To make an opening indication conveniently usable the end closure disk 2 is provided with a grip lug or a projecting part 31, which can be gripped between the fingers and pulled upwards, as a result of which the foamed plastic material will break between the cutting lines 29, 30 and it will be possible to tear off and remove the area 28 within the cutting lines, whereupon the contents of the packing container can be made readily accessible through the resulting pouring opening. In FIG. 9*a* a section along line A—A in FIG. 9 is shown and in FIG. 9*a* the support layer of foamed plastic material is designated 32 and the homogeneous plastic coatings 33, 34. The cutting lines are designated 29, 30, the area between the cutting lines which is meant to be torn up is designated 35.

In the opening indication in accordance with FIG. 9, the portion 28 between the cutting lines 29, 30 will be torn off, which in certain cases is not desirable, since it may be desired, after the pouring out of the contents from the package, to be able to re-close the same by folding down again the torn up portion. In FIG. 10 is shown a suggestion for such an opening indication, where the cutting lines 36, provided on the top part of the end closure disk 2, do not form a continuous loop but diverge from one another in the manner as shown in FIG. 10 and 10*a*. The cutting lines 37 provided on the underside of the end closure disk 2 run parallel with the cutting lines 36 over such a length as is required for setting up a sufficient pouring opening, whilst they subsequently converge towards one another. When the package is opened by pulling the area between the cutting lines 36, 37 upwards, the foam material between the cutting lines breaks in the manner mentioned earlier, as long as the cutting lines are arranged not far from one another. When one comes to the point, however, where the cutting lines depart in different directions, the distance between the cutting lines becomes too great and the opening lug cannot be torn up any farther without the use of great traction forces. When the opening lug is torn up the tearing will consequently be stopped automatically at the point where the cutting lines diverge, and there is no danger of the lug being torn off, but the same can be used for a possible reclosing of the package after the intended quantity of the contents has been emptied out.

In FIG. 11 is shown a further emptying device, which is also illustrated in FIG. 11*a*, which shows a section along line C—C in FIG. 11. In the package in accordance with FIG. 11 a cutting line 40 is provided in the top side of the end plate 2 whilst a smaller cutting line 41, running parallel with the cutting line 40, is provided in the underside of the end plate 2, whereby it is possible to remove the area 39 between the cutting lines 40, 41 in the manner described earlier. It is difficult, however, in an opening device of this type to be able to grip the area 39 intended for tearing off with the fingers so as to pull it upwards and thereby separate it from the end closure disk 2. In the present case the foamed plastic material along an area 42 directly outside the cutting line 40, is compressed in such a manner that it is possible to grip it with the nail underneath the area 39 and tear up the same to form a pouring opening. It is of course also possible to press the part 39 into the package if this manner of opening does not otherwise entail some disadvantage.

To create a better pouring edge, it may be appropriate to arrange the pouring edge along a corner of the packing container, as is shown in FIG. 12, where the cutting lines 44, 45 are provided on the top side and underside respectively of the end closure disk 2, whereby it is possible in the manner described earlier to tear up the part 43 situated between the cutting lines 44, 45 which is illustrated in FIG. 12*a*. The corner portion 48 laid open forms an excellent pouring edge, which facilitates the emptying of the packing container.

It has been found that packing containers with wholly plane sides present outwards bulging sides when they are filled with the intended contents, e.g. milk or other liquid, unless the side walls of the package body 1 are very rigid in their shape. When it is not possible for reasons of economy to make the walls of the package body 1 very rigid it was necessary until now to accept this tendency towards outwards bulging walls, which, however, is a considerable inconvenience in connection with automatic packing and handling of the packing containers when the outer dimensions of the packing containers are altered. With the intention of avoiding such inconveniences or of counter-acting the tendency it is possible, as can be seen in FIG. 13, to manufacture the container body 1 with slightly inwards bulging side walls 46. FIG. 13 may be for example a section D—D of FIG. 1, and when the liquid contents are filled into the packing container before closure of the same, the static pressure of the contents will press-out the inwards bulging walls 46, so that they assume approximately the contours shown in broken lines 49. The desired inwards bulging wall portions 46 can be easily obtained in the case where the packing material for the container body 1 is wound up on a storage roll, and consequently has a natural tendency towards curvature which is conditioned by the radius of the storage roll. If a package blank for the container body 1 is manufactured from such a material of paper, cardboard or foam plastic wound on a storage roll, the blank is oriented so on the packing material that the tendency towards curvature will act parallel to the longitudinal axis of the finished container body 1, and moreover the punched out blank is bent and folded to the container body 1 in such a manner that the curvature will be directed inwards towards the tubular space formed by the container body.

The description of the packing container in accordance with the invention given above would not be complete if it were not pointed out at the same time that in the foamed plastic material, as well as in the homogeneous plastic layer, fillers of organic or inorganic material, such as e.g. gypsum, stone dust, kaolin or other cheap fillers can be incorporated which on the one hand increase the rigidity of the plastic material and on the other hand make the packing material cheaper in that a smaller amount of plastic need be used. These materials with filler may be used in the end closure disks as well as in the container body.

In case of the end closure disks being manufactured of foamed plastic, e.g. polystyrene foam, it has been found appropriate to use a foamed plastic layer of a thickness of between 0.5 and 2 mm, together with homogeneous plastic layers of a thickness of less than 0.2 mm provided on either side of the support layer. Naturally, for other special purposes thicker or thinner support layers may be used, but for the great majority of packages the dimensional rules given above are appropriate.

In addition to the aforementioned opening arrangements with cutting lines or tearing thread provided in the end closure disk it is possible to provide in advance a pouring hole in the end closure disk 2, which pouring hole can be covered by a tear-off cover strip which is attached to the top side of the end closure disk around the pouring hole provided. The said cover strip may in the area of the pouring hole be drawn down into the pouring hole, e.g. with the help of vacuum or pressure. The cover stip may have on the underside of the pouring hole a widened part by virtue of which the cover stip after tearing off can be re-inserted in the pouring hole with the help of a so-called spring-fastener effect or snap effect. In the case mentioned above it is appropriate to allow the end closure disk to project with one free edge beyond the container body 1, since it has been found that the liquid contents can easily be poured over such a freely projecting edge, whilst it is considerably more difficult to pour the contents over a rounded, foldeddown edge.

It has been found that the packing container in accordance with the present invention can readily be manufactured on automatic packing machines, e.g. of the type which has mandrels arranged starlike around an axle and which mandrels can be moved from one machining station to the other, at which stations the different phases of the work, e.g. the pushing on or rolling up of the blank to container bodies 1 and the putting on of the end closure disk can be carried out. During the same course of operations the heating of the parts which are to be sealed to one another can take place at these stations, whilst at other stations at the same time the pressing or pressing together of the parts joined together is carried out. A further, very substantial advantage of packing containers in accordance with the invention is that the consumption of material is a minimum, since the overlapping portions required for the sealing can be made very narrow. On one and the same packing container combinations of the end closure plates as described above can be applied. Thus it may be appropriate, in one and the same packing container, first to put on an end closure in accordance with FIG. 4, that is to say an end closure disk with flange folded inwards, whereupon later, after the packing container so formed has been filled with the intended contents, a further end closure disk in accordance with FIG. 3 can be inserted in the re-established opening of the container. In such a case it may be appropriate for the subsequently inserted end closure disk to form the base of the packing container, whilst the end plate inserted first, which gives a plane end wall, can advantageously form the top side of the packing container and be provided with any one of the opening arrangements described.

We claim:

1. A packing container comprising a rectangular container body open at opposed ends and composed of a packaging material having coatings of a homogeneous plastic material on both sides thereof, closure panel members for closing the open ends of said container body and composed of foamed polystyrene having a thickness of from 0.5 to 2 mm. and having coatings of a homogeneous plastic material on both sides thereof and of a thickness not greater than 0.2 mm., the marginal edge portions of said closure panel members being secured to the end edges of said container body by a thermoplastic bonding agent, at least one of said marginal edge portions and the end edges of said container body being compressed together, said closure panel members including a downwardly extending skirt portion around at least a portion of said closure panel members, said skirt portions being sealed to the outer wall of said container body, the walls of said container body normally flexing inwardly when the container is empty but assuming a vertical position when the container is filled.

2. A packing container as claimed in claim 1 wherein the packaging material of said container body is composed of a fibrous material and the homogeneous plastic coatings thereon are composed of a material selected from the group consisting of polyolefins and polystyrene.

3. A packing container as claimed in claim 1 wherein the packaging material of the container body is composed of polystyrene foam and the homogeneous plastic coatings are composed of polystyrene.

4. A packing container as claimed in claim 1 wherein said packaging material of said container body includes a filler material.

* * * * *